US011094456B2

(12) United States Patent
Wang et al.

(10) Patent No.: US 11,094,456 B2
(45) Date of Patent: Aug. 17, 2021

(54) WIRELESS POWER TRANSMISSION DEVICE

(71) Applicant: Tyco Electronics (Shanghai) Co. Ltd., Shanghai (CN)

(72) Inventors: Shaoyong Wang, Shanghai (CN); Yuming Song, Shanghai (CN); Feng Dai, Shanghai (CN); Li Zou, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 1294 days.

(21) Appl. No.: 15/353,271

(22) Filed: Nov. 16, 2016

(65) Prior Publication Data

US 2017/0069422 A1 Mar. 9, 2017

Related U.S. Application Data

(63) Continuation of application No. PCT/CN2015/078177, filed on May 4, 2015.

(30) Foreign Application Priority Data

May 16, 2014 (CN) ..... 201410208565.9

(51) Int. Cl.

| | |
|---|---|
| ***H01F 38/14*** | (2006.01) |
| ***H01J 7/00*** | (2006.01) |
| ***H01F 1/34*** | (2006.01) |
| ***H01F 27/28*** | (2006.01) |

(52) U.S. Cl.

CPC ..... *H01F 38/14* (2013.01); *H01F 1/342* (2013.01); *H01F 27/2823* (2013.01); *H01J 7/00* (2013.01)

(58) Field of Classification Search

CPC ..... H01F 38/14; H01F 27/2823; H01F 2038/143; H01F 2038/146; H01F 38/18

USPC ..... 336/200, 232

See application file for complete search history.

(56) References Cited

U.S. PATENT DOCUMENTS

| | | | | |
|---|---|---|---|---|
| 6,127,800 | A * | 10/2000 | Kuki | B60L 53/34 320/108 |
| 2013/0015719 | A1 | 1/2013 | Jung et al. | |
| 2014/0084699 | A1* | 3/2014 | Sugino | H01F 38/14 307/104 |
| 2015/0091514 | A1* | 4/2015 | Yuasa | H02J 50/80 320/108 |

FOREIGN PATENT DOCUMENTS

| | | | |
|---|---|---|---|
| CN | 1819397 | A * | 8/2006 |
| CN | 1819397 | A | 8/2006 |

(Continued)

OTHER PUBLICATIONS

International Search Report, dated Aug. 4, 2015, 12 pages.

(Continued)

*Primary Examiner* — Tszfung J Chan
(74) *Attorney, Agent, or Firm* — Barley Snyder

(57) ABSTRACT

A wireless power transmission device is disclosed. The wireless power transmission device comprises a first coil and a second coil electromagnetically coupled to the first coil without contacting the first coil. A portion of one of the first coil and the second coil extends through a space defined by the other of the first coil and the second coil.

22 Claims, 5 Drawing Sheets

(56) References Cited

FOREIGN PATENT DOCUMENTS

| | | | | | |
|---|---|---|---|---|---|
| CN | 101478182 | A | | 7/2009 | |
| CN | 101645617 | A | | 2/2010 | |
| CN | 201887566 | U | | 6/2011 | |
| EP | 0510926 | A2 | * | 10/1992 | ..... H01F 38/18 |
| EP | 0510926 | A2 | | 10/1992 | |
| JP | 10225021 | A | * | 8/1998 | |
| JP | 2005137173 | A | * | 5/2005 | ..... H01F 38/14 |
| JP | 2005289101 | A | * | 10/2005 | |
| JP | 2005289101 | A | | 10/2005 | |
| JP | 2009060762 | A | * | 3/2009 | |
| JP | 2009060762 | A | | 3/2009 | |
| JP | 2009284695 | A | | 12/2009 | |
| WO | 2013146929 | A1 | | 12/2015 | |

OTHER PUBLICATIONS

Abstract of CN101645617, dated Feb. 10, 2010, 1 page.
Abstract of CN101478182, dated Jul. 8, 2009, 1 page.
Abstract of CN201887566, dated Jun. 29, 2011, 1 page.
Abstract of JP2009284695, dated Dec. 3, 2009, 2 pages.
Notice to File a Response in Korean and English, dated Oct. 19, 2017, 9 pages.
Abstract of WO2013146929, dated Dec. 14, 2015, 1 page.
European Search Report, dated Nov. 30, 2017, 13 pages.

* cited by examiner

WIRELESS POWER TRANSMISSION DEVICE

CROSS-REFERENCE TO RELATED APPLICATIONS

This application is a continuation of PCT International Application No. PCT/CN2015/078177, filed on May 4, 2015, which claims priority under 35 U.S.C. § 119 to Chinese Patent Application No. 201410208565.9, filed on May 16, 2014.

FIELD OF THE INVENTION

The present invention relates to a wireless power transmission device, and more particularly, to a wireless power transmission device adapted to wirelessly transmit power through an electromagnetic coupling.

BACKGROUND

Electric power required by control components and drive components of known electrical apparatuses is obtained mainly through external wirings or built-in batteries. The electric power is transmitted by a physical connection through power lines in the apparatus. Therefore, physical wear is prone to occur in some regions in which moving parts are located, resulting in some security, lifetime and maintenance issues for the electrical apparatus.

Due to the potential for wear of physical power transmission lines, electrical apparatuses having wireless power transmission, such as by the coil couplings shown in FIG. 1, are known in the art. The known wireless power transmission device of FIG. 1 comprises a first spiral coil 1 (e.g., a transmitting coil) received in a first housing 3 and a second spiral coil 2 (e.g., a receiving coil) received in a second housing 4. The first spiral coil 1 and the second spiral coil 2 are separated from each other by a predetermined distance in a direction along their central axes. Ends of the two coils 1, 2 are parallel to and spaced apart from each other. The two coils 1, 2 are electromagnetically coupled such that electric power is wirelessly transmitted between the first spiral coil 1 and the second spiral coil 2.

The coil 1, 2, structure of the wireless power transmission device of FIG. 1, however, has operating difficulties in certain applications. The power receiving coil mounted in moving parts needs to maintain some electric characteristics, such as a constant voltage, current, power or the like within a certain motion range. However, it is very difficult for the separated coupling structure shown in FIG. 1 to maintain these characteristics. Furthermore, since the two coils 1, 2 are spatially separated and independent from each other over a coupling distance, a coupling strength between the coils 1, 2 is small, and an effective coupling distance is very short, typically less than 10 mm. In order to obtain stronger electromagnetic coupling and a longer coupling distance, it is necessary to increase a diameter and a thickness of the coils 1, 2, however, this would lead to a wireless power transmission device with an excessive size.

SUMMARY

An object of the invention, among others, is to provide a wireless power transmission device with a small size capable of maintaining a strong and constant coupling within a motion range. The disclosed wireless power transmission device comprises a first coil and a second coil electromagnetically coupled to the first coil without contacting the first coil. A portion of one of the first coil and the second coil extends through a space defined by the other of the first coil and the second coil.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a wireless power transmission device. This invention may, however, be embodied in many different forms and should not be construed as limited to the embodiments set forth herein; rather, these embodiments are provided so that this disclosure will be thorough and complete and still fully convey the scope of the invention to those skilled in the art.

A wireless power transmission device according to the invention is shown in FIGS. 2-5. The wireless power transmission device has a first coil 11 and a second coil 12 spaced apart from and electromagnetically coupled to the first coil 11. In the embodiments shown in FIGS. 2-5, a portion of one of the first coil 11 and the second coil 12 extends through a space defined by the other of the first coil 11 and the second coil 12.

Figure 1:
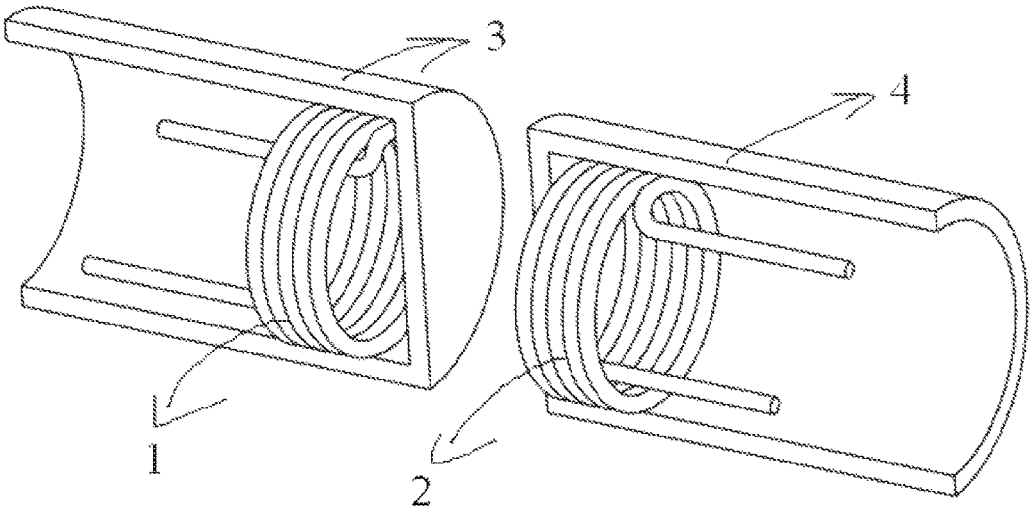
Fig.1 PRIOR ART
FIG. 1 is a perspective view of an electromagnetic coupling device known in the prior art.
Figure 2:
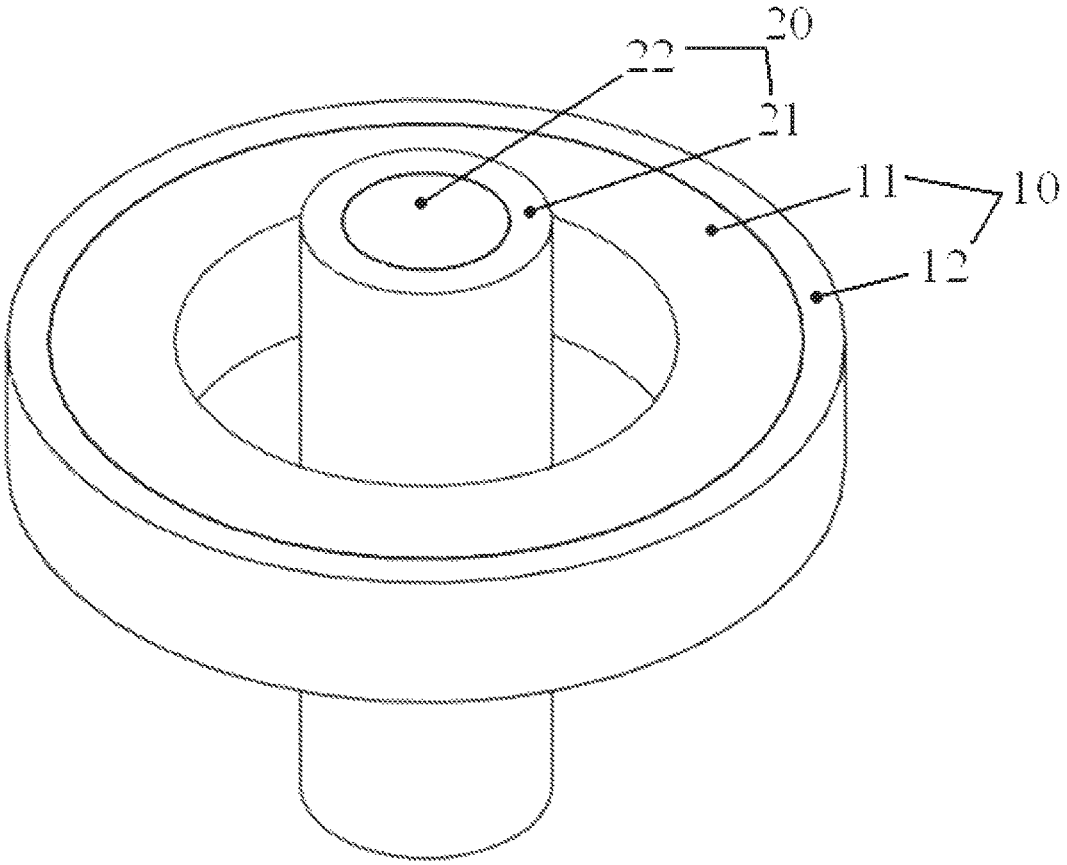
FIG. 2 is a perspective view of a wireless power transmission device according to a first embodiment of the invention.

A wireless power transmission device according to a first embodiment of the invention is shown in FIG. 2. As shown in FIG. 2, the wireless power transmission device has a first coil 11 and a second coil 21 electromagnetically coupled with the first coil 11 without contacting the first coil 11. One of the first coil 11 and the second coil 21 is a transmitting coil, and the other is a receiving coil.

The first coil 1 is a spiral coil defining a hollow annular space internally. A central axis of the first coil 11 passes through the annular space, and the second coil 21 passes through the first coil 11 in the annular space. In the shown embodiment, a central axis of the second coil 21 is coincident with that of the first coil 11. Alternatively, the central axis of the first coil 11 may not be coincident with or parallel to that of the second coil 21, for example, the central axis of the first coil 11 may be perpendicular to or angled with respect to the central axis of the second coil 21. An angle between the central axes of the first and second coils 11 and 21 may be greater than 0 degrees and less than 90 degrees, greater than 0 degrees and less than 30 degrees, greater than 0 degrees and less than 15 degrees, greater than 0 degrees and less than 10 degrees, or greater than 0 degrees and less than 5 degrees.

In order to improve an electromagnetic coupling between the first coil 11 and the second coil 21, as shown in FIG. 2, a first magnetic core 12 is provided outside the first coil 11. The first magnetic core 12 surrounds an outer circumferential surface of the first coil 11. The first coil 11 and the first magnetic core 12 together form a first coil assembly 10.

A second magnetic core 22 is disposed inside the second coil 21. The second coil 21 surrounds an outer circumferential surface of the second magnetic core 22, for example, the second coil 21 may be wound around the second magnetic core 22. The second coil 21 and the second magnetic core 22 together form a second coil assembly 20.

The second coil assembly 20, as shown in FIG. 2, extends through the first coil assembly 10 in the annular space defined by the first coil 11 without contacting the first coil 11. The first coil 11 is rotatable around its central axis, and the second coil 21 is movable in a direction along its central axis.

The first coil 11 and the second coil 21 may be spiral coil windings, for example, spiral coil windings formed on the first and second coils 11, 21 on the first and second magnetic cores 12, 22, respectively.

The first magnetic core 12 and the second magnetic core 22 may be made of a soft magnetic material such as ferrite material or plasto-ferrite material. Since a strength of coupling between coils 11, 21 is essential for efficient power transmission, in order to generate sufficient electromagnetic coupling between coils of small size, the first magnetic core 12 and the second magnetic core 22 may be made of a conventional ferrite material such as Mn—Zn oxide ferrite material or Ni—Zn oxide ferrite material. However, the Mn—Zn oxide ferrite material and the Ni—Zn oxide ferrite material have disadvantages that they cannot be injection molded into a complex shape and have a large weight. In order to overcome these disadvantages of the Mn—Zn oxide ferrite material and the Ni—Zn oxide ferrite material, a plasto-ferrite material having a low initial permeability (typically 5-20), a light weight, and capable of easy injection molding into a variety of complex shapes may be used for the first magnetic core 12 and the second magnetic core 22.

The first coil 11 and the first magnetic core 12, as shown in FIG. 2, are formed as a hollow cylindrical shape, the second coil 21 is formed as a hollow cylindrical shape, and the second magnetic core 22 is formed as a solid cylindrical shape. Alternatively, the first coil 11 and the first magnetic core 12 may be formed as a hollow prismatic shape, pyramidal shape or other suitable shapes known to those with ordinary skill in the art. Further, the second coil 21 may be formed as a hollow prismatic shape, pyramidal shape or other suitable shapes known to those with ordinary skill in the art, and the second magnetic core 22 may be formed as a solid prismatic shape, pyramidal shape or other suitable shapes known to those with ordinary skill in the art.

Figure 3:
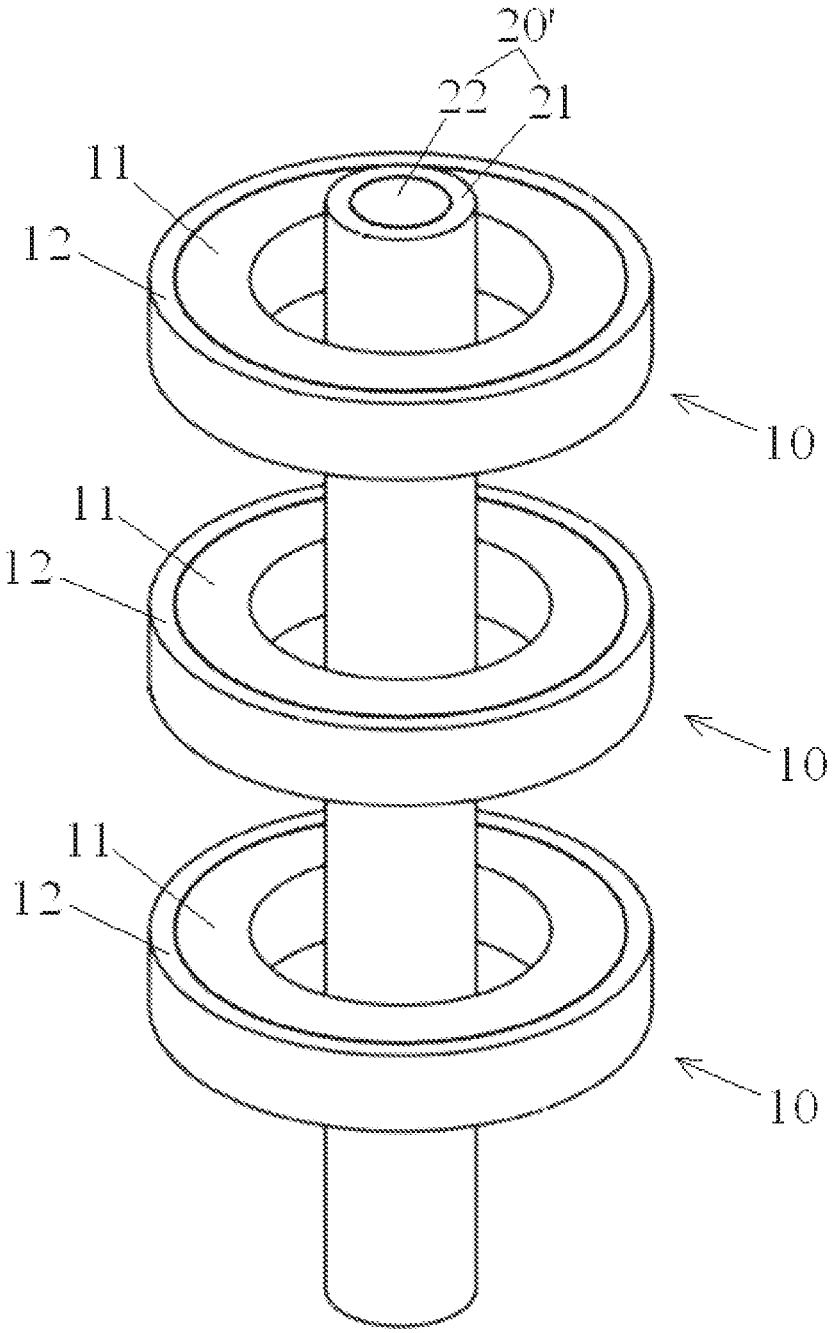
FIG. 3 is a perspective view of a wireless power transmission device according to a second embodiment of the invention.

A wireless power transmission device according to a second embodiment of the invention is shown in FIG. 3. The wireless power transmission device according to the embodiment shown in FIG. 3 differs from the embodiment shown in FIG. 2 in that the wireless power transmission device according to the embodiment shown in FIG. 2 comprises only one first coil assembly 10, while the wireless power transmission device according to the embodiment shown in FIG. 3 comprises a plurality of first coil assemblies 10.

As shown in FIG. 3, the wireless power transmission device comprises a plurality of first coil assemblies 10 and a second coil assembly 20'. The second coil assembly 20' extends through the plurality of first coil assemblies 10 in an annular space defined by each of the first coils 11 of the plurality of first coil assemblies 10, respectively, without contacting any of the first coil assemblies 10. The second coil assembly 20' has a long length along its central axis so as to extend through the plurality of first coil assemblies 10. Central axes of the first coils 11 are coincident with a central axis of the second coil 21.

Figure 4:
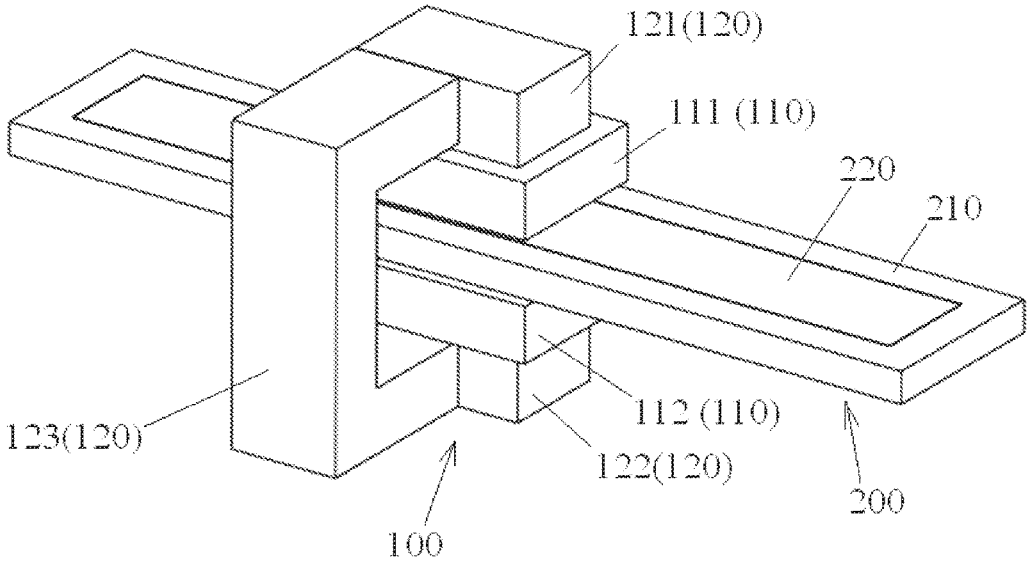
FIG. 4 is a perspective view of a wireless power transmission device according to a third embodiment of the invention.

A wireless power transmission device according to a third embodiment of the invention is shown in FIG. 4. As shown in FIG. 4, the wireless power transmission device comprises a first coil 110 and a second coil 210 electromagnetically coupled to the first coil 110 without contacting the first coil 110. One of the first coil 110 and the second coil 210 is a transmitting coil, and the other is a receiving coil.

The first coil 110 includes a first portion 111 and a second portion 112 opposite to the first portion 111. The first portion 111 and the second portion 112 of the first coil 110 are spaced apart from each other, however, the first portion 111 and the second portion 112 of the first coil 110 are formed by winding the same wire. A space is defined between the first portion 111 and the second portion 112 of the first coil 110. A central axis of the first coil 110 passes through the space, and the second coil 210 passes between the first portion 111 and the second portion 112 of the first coil 110 in the space.

As shown in FIG. 4, a central axis of the second coil 210 is parallel to that of the first coil 110. Alternatively, the central axis of the first coil 110 may be perpendicular to or angled with that of the second coil 210. An angle formed between the central axes of the first and second coils 110, 210 may be greater than 0 degrees and less than 90 degrees, greater than 0 degrees and less than 30 degrees, greater than 0 degrees and less than 15 degrees, greater than 0 degrees and less than 10 degrees, or greater than 0 degrees and less than 5 degrees.

In order to improve an electromagnetic coupling between the first coil 110 and the second coil 210, as shown in FIG. 4, the first coil 110 has a first magnetic core 120, and the second coil 210 has a second magnetic core 220.

The first magnetic core 120 comprises a U-shaped body portion 123, a first block 121 connected to a side (upper side in FIG. 4) of the U-shaped body portion 123 at an opening thereof, and a second block 122 connected to an opposite side (lower side in FIG. 4) of the U-shaped body portion 123 at the opening. The first portion 111 of the first coil 110 is wound around the first block 121 of the first magnetic core 120, and the second portion 112 of the first coil 110 is wound around the second block 122 of the first magnetic core 120. The first coil 110 and the first magnetic core 120 together form a first coil assembly 100.

The second magnetic core 220 has an elongated rectangular parallelepiped shape, and the second coil 210 is wound around an outer periphery of the second magnetic core 220. In this way, the second coil 210 and the second magnetic core 220 together form a second coil assembly 200. As shown in FIG. 4, the second coil assembly 200 extends through the first coil assembly 100 in the space between the first portion 111 and the second portion 112 of the first coil 110 without contacting the first coil assembly 100.

The first magnetic core 120 and the second magnetic core 220 may be made of a soft magnetic material such as a ferrite or plasto-ferrite material. Since a strength of coupling between the coils 110, 210 is essential for efficient power transmission, in order to generate sufficient electromagnetic coupling between coils of small size, the first magnetic core 120 and the second magnetic core 220 may be made of a conventional ferrite material such as Mn—Zn oxide ferrite material or Ni—Zn oxide ferrite material. However, the Mn—Zn oxide ferrite material and the Ni—Zn oxide ferrite material have disadvantages that they cannot be injection molded into a complex shape and have a large weight. In order to overcome these disadvantages of the Mn—Zn oxide ferrite material and the Ni—Zn oxide ferrite material, a plasto-ferrite material having a low initial permeability (typically 5-20), light weight, and capable of easy injection molding into a variety of complex shapes may be used for the first magnetic core 120 and the second magnetic core 220.

As shown in FIG. 4, the first magnetic core 120 and the second magnetic core 220 have substantially rectangular cross sections. The cross section of each of the first magnetic core 120 and the second magnetic core 220 may alternatively have a circular, oval, triangular, trapezoidal, square shape, or other suitable shapes known to those with ordinary skill in the art.

Figure 5:
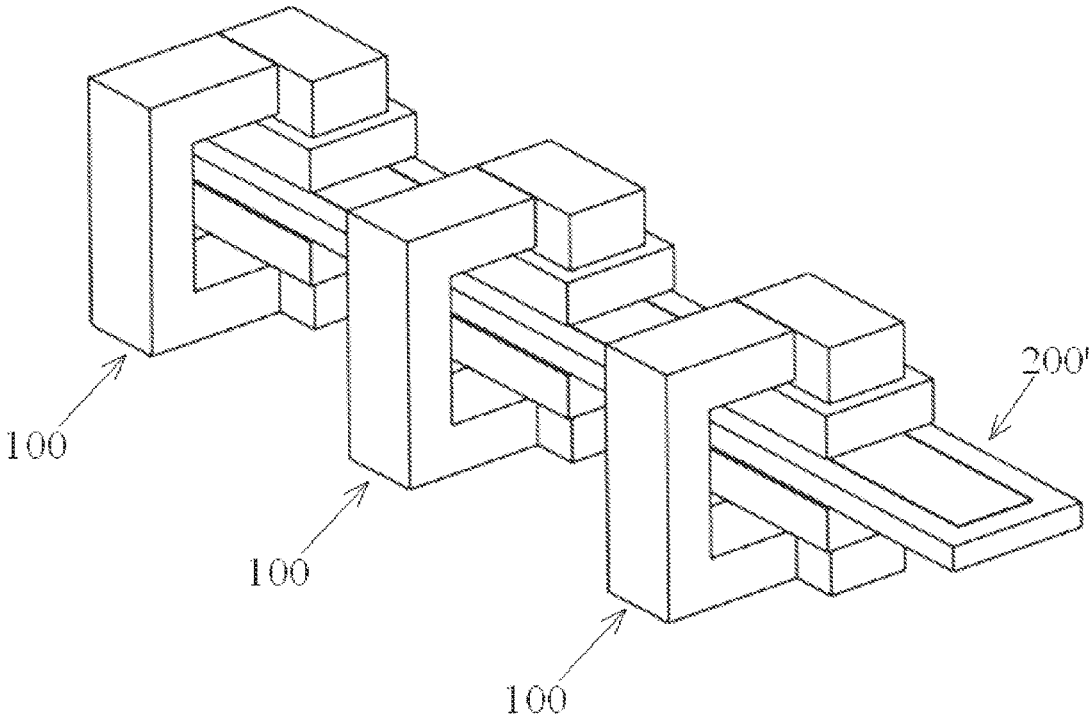
FIG. 5 is a perspective view of a wireless power transmission device according to a fourth embodiment of the invention.

A wireless power transmission device according to a fourth embodiment of the invention is shown in FIG. 5. The wireless power transmission device according to the embodiment shown in FIG. 5 differs from that according to the embodiment shown in FIG. 4 in that the wireless power transmission device according to the embodiment shown in FIG. 4 comprises only one first coil assembly 100, while the wireless power transmission device according to the embodiment shown in FIG. 5 comprises a plurality of first coil assemblies 100.

As shown in FIG. 5, the wireless power transmission device comprises a plurality of first coil assemblies 100 and a second coil assembly 200'. The second coil assembly 200' extends through the plurality of first coil assemblies 100 in a space defined by the first portion 111 and the second portion 112 of each of the first coils 110 of the plurality of first coil assemblies 100, respectively, without contacting any of the first coil assemblies 100. The second coil assembly 200' has a long length in a direction along its central axis so as to extend through the plurality of first coil assemblies 100. Central axes of the first coils 110 are positioned in the same plane as the central axis of the second coil 210.

Advantageously, in the wireless power transmission device according to various embodiments of the present invention, since one of a transmitting coil and a receiving coil passes through the other of the transmitting coil and the receiving coil, a strength of electromagnetic coupling between the two coils can be improved, being substantially constant within a motion range, without increasing sizes of the coils.

What is claimed is:

1. A wireless power transmission device, comprising:

a first coil including a first portion and a second portion opposite the first portion, the first portion and second portion defining a space therebetween;

a second coil electromagnetically coupled to the first coil without contacting the first coil, a portion of the second coil extending through the space defined by the first coil;

a first magnetic core disposed outside the first coil and forming a first coil assembly with the first coil, the first magnetic core comprising:

a U-shaped body portion;

a first rectangular block connected to a side of the U-shaped body portion at an opening thereof, the first portion of the first coil wound around the first block; and a second rectangular block connected to an opposite side of the U-shaped body portion at the opening, the second portion of the first coil wound around the second block; and a second magnetic core disposed inside the second coil and forming a second coil assembly with the second coil, the second coil assembly extending through the first coil assembly in the space without contacting the first coil assembly, wherein the first rectangular block and the second rectangular block extend from a respective side of the U-shaped body in a direction of extension of the second coil assembly through the first coil assembly, and wherein the device includes a plurality of first coil assemblies, the second coil assembly including the second magnetic core simultaneously extending through the plurality of first coil assemblies including the first magnetic core in the space without contacting any of the first coil assemblies.

2. The wireless power transmission device of claim 1, wherein a central axis of the first coil extends through the space defined by the first coil.

3. The wireless power transmission device of claim 2, wherein the central axis of the first coil is parallel to a central axis of the second coil.

4. The wireless power transmission device of claim 2, wherein the central axis of the first coil is perpendicular to a central axis of the second coil.

5. The wireless power transmission device of claim 2, wherein the central axis of the first coil is angled with respect to a central axis of the second coil.

6. The wireless power transmission device of claim 1, wherein the first coil and the second coil are spiral coil windings formed on the first magnetic core and the second magnetic core, respectively.

7. The wireless power transmission device of claim 6, wherein the first magnetic core and the second magnetic core are made of a soft magnetic material.

8. The wireless power transmission device of claim 7, wherein the first magnetic core and the second magnetic core are made of a ferrite material or a plasto-ferrite material.

9. The wireless power transmission device of claim 7, wherein the first magnetic core and the second magnetic core are made of Mn—Zn oxide ferrite material or Ni—Zn oxide ferrite material.

10. The wireless power transmission device according to claim 9, wherein the first coil and the first magnetic core are formed as a hollow cylindrical, prismatic, or pyramidal shape, the second coil is formed as a hollow cylindrical, prismatic, or pyramidal shape, and the second magnetic core is formed as a solid cylindrical, prismatic, or pyramidal shape.

11. The wireless power transmission device of claim 1, wherein the second magnetic core has an elongated rectangular parallelepiped shape, and the second coil is wound around an outer periphery of the second magnetic core.

12. The wireless power transmission device of claim 11, wherein the first magnetic core and the second magnetic core are made of a soft magnetic material.

13. The wireless power transmission device of claim 12, wherein the first magnetic core and the second magnetic core are made of a ferrite material or a plasto-ferrite material.

14. The wireless power transmission device of claim 13, wherein the first magnetic core and the second magnetic core are made of Mn—Zn oxide ferrite material or Ni—Zn oxide ferrite material.

15. The wireless power transmission device of claim 13, wherein each of the first magnetic core and the second magnetic core has a circular, oval, triangular, trapezoidal, rectangular or square cross section.

16. The wireless power transmission device of claim 1, wherein the first rectangular block and the second rectangular block extend in a direction of elongation of the second coil assembly, wherein centers of the first rectangular block and the second rectangular block are offset in the direction of elongation from a center of the U-shaped body.

17. A wireless power transmission device, comprising:

a first coil including a first portion and a second portion opposite the first portion, the first portion and second portion defining a space therebetween;

a second coil electromagnetically coupled to the first coil without contacting the first coil, a portion of the second coil extending through the space defined by the first coil;

a first magnetic core disposed outside the first coil and forming a first coil assembly with the first coil; and a second magnetic core disposed inside the second coil and forming a second coil assembly with the second coil, the second coil wound around an outer periphery of the second magnetic core and extending through the first coil assembly in the space without contacting the first coil assembly, wherein the device comprises a plurality of first coil assemblies, the second coil assembly including the second magnetic core simultaneously extending through the plurality of first coil assemblies including the first magnetic core in the space without contacting any of the first coil assemblies.

18. The wireless power transmission device of claim 17, wherein the first magnetic core comprises a body portion having a first end and a second end opposite the first end, wherein the first portion of the first coil is wound around the first end and the second portion of the first coil is wound around the second end.

19. The wireless power transmission device of claim 18, wherein the body portion comprises a U-shaped body portion.

20. The wireless power transmission device of claim 17, wherein the second magnetic core has an elongated rectangular parallelepiped shape.

21. The wireless power transmission device of claim 18, wherein the first end of the body portion includes a first block connected to a side of the body portion at an opening thereof and the second end of the body portion includes a second block connected to an opposite side of the body portion at the opening.

22. The wireless power transmission device of claim 21, wherein the first portion of the first coil is wound around the first block and the second portion of the first coil is wound around the second block.

* * * * *